US008424602B2

(12) United States Patent
Thimm

(10) Patent No.: US 8,424,602 B2
(45) Date of Patent: Apr. 23, 2013

(54) GAS-ASSISTED PROCESS FOR IN-SITU BITUMEN RECOVERY FROM CARBONATE RESERVOIRS

(75) Inventor: Harald F. Thimm, Calgary (CA)

(73) Assignee: Thimm Petroleum Technologies Inc., Calgary (CA)

( * ) Notice: Subject to any disclaimer, the term of this patent is extended or adjusted under 35 U.S.C. 154(b) by 0 days.

(21) Appl. No.: 12/702,126

(22) Filed: Feb. 8, 2010

(65) Prior Publication Data

US 2010/0200249 A1 Aug. 12, 2010

Related U.S. Application Data

(60) Provisional application No. 61/150,650, filed on Feb. 6, 2009.

(51) Int. Cl.
*E21B 43/24* (2006.01)
*E21B 36/00* (2006.01)

(52) U.S. Cl.
USPC ..... 166/272.3; 166/303; 166/370; 166/402

(58) Field of Classification Search ..... None
See application file for complete search history.

(56) References Cited

U.S. PATENT DOCUMENTS

| | | | | |
|---|---|---|---|---|
| 4,217,956 | A * | 8/1980 | Goss et al. | 166/272.3 |
| 5,056,596 | A * | 10/1991 | McKay et al. | 166/402 |
| 2010/0282644 | A1 * | 11/2010 | O'Connor et al. | 208/427 |

FOREIGN PATENT DOCUMENTS

| | | |
|---|---|---|
| CA | 1130201 | 8/1982 |
| CA | 2015460 | 12/1993 |
| CA | 2015459 | 8/1995 |
| CA | 2277378 | 9/2002 |
| CA | 2591498 | 2/2010 |

OTHER PUBLICATIONS

Thimm, Harald , "*A General Theory of Gas Production in SAGD Operations*" . From Journal of Canadian Petroleum Technology - Nov. 2001, vol. 40, No. 11.

* cited by examiner

*Primary Examiner* — Zakiya W Bates
(74) *Attorney, Agent, or Firm* — SNR Denton US LLP

(57) ABSTRACT

A method for producing bitumen or heavy oil from a subterranean reservoir comprising a carbonate mineral solid matrix comprising injection or co-injection of a gas other than carbon dioxide, injection or co-injection of a carbon containing gas containing a relatively low amount of carbon dioxide, injection of steam providing bicarbonate/alkalinity, or increasing the subterranean reservoir pressure, such that the dissolution and re-precipitation of carbonates is suppressed thereby.

28 Claims, 2 Drawing Sheets

| Carbon Dioxide, mol/L | Limestone Gram/$m^3$ water | Dolomite Gram/$m^3$ water |
|---|---|---|
| 0.01 | 3.1 | 0.28 |
| 0.02 | 4.8 | 0.42 |
| 0.03 | 6.5 | 0.54 |
| 0.04 | 8.3 | 0.63 |
| 0.05 | 10.0 | 0.84 |
| 0.06 | 11.5 | 1.02 |
| 0.07 | 13.0 | 1.19 |
| 0.08 | 14.5 | 1.36 |
| 0.09 | 16.3 | 1.53 |
| 0.10 | 18.0 | 1.70 |
| 0.11 | 19.5 | 1.87 |
| 0.12 | 21.3 | 2.03 |
| 0.13 | 23.0 | 2.19 |
| 0.14 | 24.5 | 2.38 |
| 0.15 | 26.0 | 2.56 |

Fig. 2

GAS-ASSISTED PROCESS FOR IN-SITU BITUMEN RECOVERY FROM CARBONATE RESERVOIRS

CROSS REFERENCE TO RELATED APPLICATIONS

This application claims the benefit of priority of U.S. Provisional Patent Application No. 61/150,650 filed Feb. 6, 2009, which is incorporated herein by reference in its entirety.

FIELD OF THE INVENTION

The present invention relates generally to recovery processes of heavy oil or bitumen from an underground oil-bearing formation. More particularly, the present invention relates to recovery processes of heavy oil or bitumen from underground oil-bearing formation, whose rock matrix comprises a carbonate mineral.

BACKGROUND OF THE INVENTION

Carbonate minerals are common oil-bearing formations, and usually consist of predominantly limestone (calcium carbonate) or dolomite (calcium magnesium carbonate).

More specifically, the thermal recovery of bitumen or heavy oil requires some manner of heating of the reservoir. When hot water, either injected as steam or from heating of naturally present water, is in contact with heavy oil or bitumen, chemical reactions are known to occur which, among other products, cause the liberation of carbon dioxide and hydrogen sulphide.

The carbon dioxide so formed will normally be dissolved in the water, and is thus available for attack on the carbonate, causing the formation of free calcium and magnesium ions. The reactions are for limestone $$CO_2+H_2O+CaCO_3 \rightarrow Ca^{2+}+2HCO_3^-$$

and for dolomite $$2CO_2+2H_2O+CaMg(CO_3)_2 \rightarrow Ca^{2+}+Mg^{2+}+4HCO_3^-$$

These reactions, which are responsible for the formation of limestone caves in nature, initially have the effect of opening the pore space of the carbonate rock, thus improving fluid flow. However, near the producing wellbore, the pressure is normally reduced as a consequence of the production technique used. This reduced pressure causes the at least partial reversal of the above reactions. Thus, solid carbonate material that is initially dissolved and removed at some greater distance from the production well, is re-precipitated and thus partially or wholly fills the original pore space near the production well. This effect inhibits the production of oil.

No patents or published applications at present relate to the recovery of bitumen or heavy oil from carbonate reservoirs by thermal methods that address the effect described above.

However, a number of tangentially relevant patents or applications have been published for recovery of bitumen in reservoirs that consist of unconsolidated sands.

Canadian Patent No. 1,130,201 (Butler) teaches a thermal method for recovering highly viscous oil from bitumen deposit in unconsolidated sand by means of Steam Assisted Gravity Drainage (hereinafter referred to as SAGD). The method consists of drilling two long horizontal wells, parallel and in the same direction, with one located several meters above the other. Steam is injected into the top well, thermal communication is established between the two wells, and oil and water drain continuously to the bottom well from where they are pumped to surface.

Canadian Patent No. 2,277,378 (Cyr and Coates) teaches a thermal process for recovery of viscous hydrocarbon that is operated in a similar manner as SAGD. A third parallel and co-extensive horizontal well is provided at a suitable lateral distance from the SAGD well pair described by Butler in Canadian Patent No. 1,130,201. The purpose of the third is to practice cyclic steam stimulation in such a manner as to improve the heat distribution throughout the subterranean reservoir. In the SAGD well pair, steam will tend to rise to the top of the hydrocarbon bearing structure. By cyclic steam stimulation at the third well, steam injection is alternated with oil production to achieve a more favourable heat distribution than is possible with SAGD alone.

Canadian Patent Application No. 2,591,498 (Arthur, Gittins and Chhina) teaches an extended SAGD process with a similar well configuration to U.S. Pat. No. 2,277,378 by Cyr. The purpose is likewise to access a region of bitumen which would normally be bypassed by SAGD if operated in the manner taught by Butler. The purpose here is to "access that portion of said reservoir whose hydrocarbons have not been or had not been recovered in the course of the . . . gravity controlled process". The recovery method from the third well, referred to as an infill well, is expected to be a gravity-controlled process, though not necessarily limited to SAGD. Reference is made to injection of light hydrocarbons or gases to maintain pressure once steam injection is discontinued.

Canadian Patent Nos. 2,015,459 and 2,015,460 (Kisman) teach a technique of gas injection into a thief zone in a bitumen bearing sand. This thief zone causes an unwanted degree of lateral steam migration from the vertical wells; the gas injection prevents this unwanted lateral migration by establishing a confining pressure from outside the well pattern, so that the steam cannot escape.

Some early pilots in Northern Alberta used cyclic steam stimulation in the 1980's (UNOCAL Buffalo Creek and McLean Pilots). Limited information is available in the public domain, however, the production data are public. The pilots were abandoned as uneconomic. The production data are accessible via the AccuMap® System from IHS® (www.ihs.com).

It is, therefore, desirable to provide a process for bitumen or heavy oil recovery from carbonate reservoirs.

SUMMARY OF THE INVENTION

The purpose of the invention described below is to suppress this dissolution-re-precipitation effect of carbonates.

The disadvantage of the current art is that it has not been proven successful in bitumen reservoirs where the rock matrix is a carbonate. Many billions of barrels of bitumen and oil are known to exist in the carbonate reservoirs of Northern Alberta, and are presently considered unrecoverable and thus stranded, or available for limited recoverability only. The reasons for the low recoverability may be geological, such as the existence of karsted or other highly permeable zones in a disadvantageous interval of the carbonate deposit, but the effect of the reactions above is common to all such reservoirs.

Table 1 shows the extent to which limestone and dolomite may dissolve at a range of carbon dioxide concentrations in the water present.

In embodiments of the present invention, production of bitumen and/or heavy oil is improved from reservoirs having a rock matrix consisting primarily of a carbonate mineral, such as limestone or dolomite. The vapour liquid equilibria of gases in a hot zone is utilized to limit the solubility of carbon dioxide in the water that is present in the formation, and thus limit the attack of the said carbon dioxide on the reservoir rock. This limitation of the initial attack will prevent or reduce the effects of formation damage near the production well, where initially dissolved rock material may re-precipitate with undesirable effects on the oil production rate.

The present invention will hereinafter be referred to as Gas-Assisted Thermal Recovery from Carbonates, and is directed to:

1. An operating strategy for carbonates: Thermal recovery processes for carbonates will be augmented with injection or co-injection, as the case may be, of non-condensible gas (NCG) or light hydrocarbon solvents. In addition to other known effects that such co-injection may have in sand or sandstone reservoirs (such gas blanket effects to limit heat loss to overburden or to thief zones, advantageous changes in oil viscosity in some cases), an important effect of suitably chosen gases is the prevention of formation damage as described above.

2. Potential control of bicarbonate concentrations by manipulation of the injection quality of steam: A kinetic analysis of the dissolution reaction implies that formation damage may be avoided if the alkalinity of the water in the subterranean hot zone is kept high. When a recovery project relies on source water of already high alkalinity, that alkalinity may be utilized by injection of steam at less than 100% quality. Detailed studies of formation damage chemistry are required prior to utilization of this technique, in order to avoid formation damage from other potentially undesirable reactions, such as the natural presence of soluble barium salts in the reservoir.

3. Solubility Control of Gas: In this invention, it is important that the amount of gas and certain gas components in the SAGD steam zone at any given time be carefully controlled. It is known that at high temperature and pressures of steam, gases that are normally insoluble in water become soluble. Any NCG so removed (in solution) must be replenished, and careful and regular analysis and measurement of produced gas is essential to success.

The process may utilize any gas other than carbon dioxide or mixture of gases, provided that such mixture is low enough in carbon dioxide content to show the desired effect. Normally, more carbon dioxide is tolerable in dolomites than in limestone reservoirs.

Table 1 is a Generic Rock Dissolution at 180° C. as a Function of Carbon Dioxide Molarity.

An actual concentration in the range of 0.05 to 0.10 would be typical for thermal recovery projects, given gas compositions observed in practice in sand formation projects. A dolomite dissolution rate of 1.7 gram/$m^3$ would be a potentially serious matter. A 2000 BOPD pilot at a WOR of 3 would produce about 1000 $m^3$ water per day, and might deposit 1.7 kg of dolomite scale near the wellbore at the producer. It would not take long for this to make itself felt in declining production rates.

Gas may be co-injected with steam to suppress the unwanted reactions of carbon dioxide with the carbonate rock matrix. By utilization of Henry's Law, which at its simplest form is:

At a constant temperature, the amount of a given gas dissolved in a given type and volume of liquid is directly proportional to the partial pressure of that gas in equilibrium with that liquid.

In the present case, the gas of concern is $CO_2$ and others which dissolve carbonates, such as limestone or dolomite, and the liquid is water or hydrocarbons or both within the reservoir.

The gas co-injection reduces the partial pressure of carbon dioxide and thus limits its solubility in water. This in turn limits the availability of carbon dioxide for attack on the carbonate rock.

In one aspect the present invention provides a method for producing bitumen or heavy oil from a subterranean reservoir having a carbonate mineral solid matrix including operating a thermal recovery process within the reservoir in order to produce the bitumen or heavy oil, and utilizing one or more suppression methods. The one or more suppression methods are selected from the group consisting of injecting a gas substantially free of carbon dioxide into the reservoir to decrease a partial pressure of $CO_2$ in the reservoir, injecting a carbon dioxide containing gas, containing a relatively low amount of carbon dioxide, into the reservoir to decrease the partial pressure of $CO_2$ in the reservoir, injecting wet steam into the reservoir, providing bicarbonate to increase the alkalinity in the reservoir, and increasing the reservoir pressure to decrease the partial pressure of $CO_2$ in the reservoir, such that the dissolution and re-precipitation of the carbonate mineral solid matrix is selectively suppressed.

In embodiments of the invention, the partial pressure of $CO_2$ in the reservoir is selectively controlled.

In embodiments of the invention, the thermal recovery process is steam assisted gravity drainage (SAGD), cyclic steam stimulation (CSS), or electric heating.

In embodiments of the invention, the gas comprises air.

In embodiments of the invention, the gas is co-injectied with the steam.

In embodiments of the invention, the steam has a steam quality of less than about 100 percent. In embodiments of the invention, the steam quality is less than about 80 percent.

In embodiments of the invention, the carbon dioxide containing gas comprises flue gas.

In embodiments of the invention, the flue gas comprises diluting air.

In embodiments of the invention, bitumen or heavy oil, produced water, and produced gas are produced from the reservoir.

In embodiments of the invention, the amount and composition of produced gas are determined and the gas injection varied to compensate.

In embodiments of the invention, the amount and composition of produced gas in solution in the produced water, bitumen, or heavy oil are determined and the gas injection varied to compensate.

In embodiments of the invention, light hydrocarbon solvents are injected with or instead of the gas. In embodiments of the invention, the light solvents comprise propane, butane, or pentane, or mixtures thereof.

In another aspect, two or more of the suppression methods are utilized in combination or in sequence In another aspect, one or more of the suppression methods, or combinations thereof, are used intermittently, periodically, or continuously In embodiments of the invention, the one or more suppression methods are selected from the group consisting of: injecting a gas substantially free of carbon dioxide into the reservoir to decrease the partial pressure of $CO_2$ in the reservoir; injecting a carbon dioxide containing gas, containing a relatively low amount of carbon dioxide, into the reservoir to decrease the partial pressure of $CO_2$ in the reservoir; and increasing the reservoir pressure to decrease the partial pressure of $CO_2$ in the reservoir. In addition, the method further includes monitoring the $CO_2$ partial pressure in the reservoir and adjusting one or more of the suppression methods to selectively lower the $CO_2$ partial pressure in the reservoir.

In another aspect the present invention provides a method for producing bitumen or heavy oil from a subterranean reservoir having a carbonate mineral solid matrix including operating a thermal recovery process within the reservoir in order to produce the bitumen or heavy oil, and injecting a non-condensible gas into the reservoir to decrease a partial pressure of $CO_2$ in the reservoir, such that the dissolution and re-precipitation of the carbonate mineral solid matrix is selectively suppressed.

In embodiments of the invention, the gas comprises a gas substantially free of carbon dioxide.

In embodiments of the invention, the gas comprises a carbon dioxide containing gas, containing a relatively low amount of carbon dioxide.

Other aspects and features of the present invention will become apparent to those ordinarily skilled in the art upon review of the following description of specific embodiments of the invention in conjunction with the accompanying figures.

BRIEF DESCRIPTION OF THE DRAWINGS

Embodiments of the present invention will now be described, by way of example only, with reference to the attached Figures, wherein:

FIG. 2 is a table of generic rock dissolution for limestone and dolomite at 180° C. as a function of $CO_2$ molarity.

DETAILED DESCRIPTION

Figure 1:
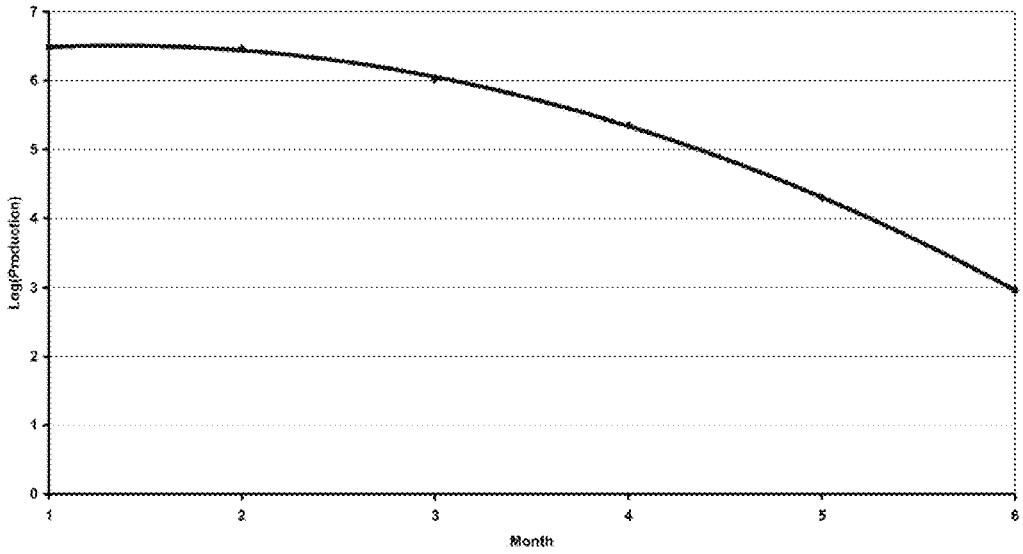
FIG. 1 is a decay curve for a Buffalo Creek Production Cycle.

Generally, the present invention provides a method and system for producing heavy oil or bitumen from a carbonate formation.

At this time, cyclic steam stimulation (CSS) is the only recovery technique utilized in pilots of bitumen from carbonates. It is normally expected that production decline curves in CSS cycles exhibits a log-linear behaviour. That is, a graph of logarithm of production rate against time is linear. However, FIG. 1 shows a production decline from a typical cycle in the Buffalo Creek pilot project (see Accumap, well 10-05-88-19W4M, July-December 1982). There is a significant deviation from the straight line that would normally be expected, and this may be assigned to a reduction in reservoir permeability towards the end of the cycle. The cause of this permeability decline is believed to be the dissolution and re-precipitation phenomenon described above.

This suppression of production rate within a CSS cycle, or during a steam assisted gravity drainage (SAGD) production period, may be reduced or eliminated by means of gas co-injection with steam. Gas may include condensable gases such as propane, butane, or pentane, or non-condensable gases.

The theory that governs the behaviour of gas in a thermal recovery zone has been described by Thimm (Journal of Canadian Petroleum Technology, Vol 40(11), pp 50-53 (November 2001)). A discussion of the effects to be expected by gas co-injection with steam, or direct gas co-injection if some other means of heating the formation is utilized, follows below. For simplicity, only the reactions applicable to limestone are given, but the analysis is similar if written for dolomite, or other carbonate.

The reaction can be analyzed on the assumption that equilibrium conditions apply to the above reaction, and the equilibrium needs to be manipulated in some way, or alternatively on the assumption that the system is not in equilibrium and the forward reaction needs to be suppressed in some way.

1. Assumption of Thermodynamic Control of the System

If thermodynamics controls the system of dissolution and re-precipitation, it is in equilibrium, and both the forward and back reactions are fast. In that case, one may write:

$$K = \frac{[Ca(HCO_3)_2]}{[CO_2]}$$

where the carbon dioxide concentration is deemed to be the aqueous concentration.

By definition of the distribution coefficient, $K_D$, of carbon dioxide $$Y_{CO2}=K_D X_{CO2}$$

and therefore $$X_{CO2} = \frac{1}{K_D}\frac{P_{CO2}}{P}$$

where the P terms represent the partial pressure of CO2 and the total system pressure respectively. The terms Y and X represent the mole fractions in gas and water respectively.

Since $$[CO_2]=55.56X_{CO2}$$

we have $$K = \frac{[Ca(HCO_3)_2]PK_D}{55.56P_{CO2}}$$

Or simplifying, one may write $$K^* = [Ca(HCO_3)_2]\frac{P}{P_{CO2}}$$

This implies that either a high total pressure and/or a low partial pressure of $CO_2$ in the system will suppress the formation of calcium bicarbonate, and by implication suppress the back reaction that would cause the formation damage referred to.

2. Assumption of Kinetic Control of the System

This scenario assumes that the forward reaction is not fast, and that some time would elapse before the system reached equilibrium. The analysis therefore has to be a kinetic one. The most common situation is that an attack on a mineral surface is first order in the aqueous reagent.

The key to control of formation damage by re-precipitation is also that the forward reaction of carbonate rock with $CO_2$ must be suppressed, so one can ignore the kinetics of the back reaction and look only at the initial rate of the forward reaction.

In general, there are two reactions. The first is the one by carbon dioxide. However, carbon dioxide also lowers the pH and creates hydrogen ion by hydrolysis, and the hydrogen ion itself is capable of attacking the carbonate. So one has $$H_2O+CO_2+CaCO_3 \rightarrow Ca^{2+}+2HCO_3^- \text{ (only forward reaction is considered)} \qquad \text{Reaction 1}$$

$$2H^++CaCO_3 \rightarrow Ca^{2+}+H_2O+CO_2 \qquad \text{Reaction 2}$$

We then use the concentration rate of change of free calcium as a surrogate for the reaction rates. This is appropriate because the analytical calcium concentration is given by $$\{[Ca^{2+}]\}=[Ca^{2+}]_R+[Ca^{2+}]_0$$

where the left hand term is the analytical concentration. On the right hand side, the first term is that due to the reactions 1 and 2, and the second term is the connate water calcium background. The second term is constant, so the time derivative of the analytical concentration and of the reaction calcium is the same. Assigning rate constants k1 and k2 for the reactions as numbered, we get $$\frac{d[Ca^{2+}]}{dt} = k_1[H^+] + k_2[CO_2]$$

From part 1 it is already known that $$[CO_2] = \frac{55.56}{K_D}\frac{P_{CO2}}{P}$$

We also have the acid-base equilibrium
$CO_2+H_2O \leftrightarrow H^+ + HCO_3^-$
so that $$K_1 = \frac{[HCO_3^-][H^+]}{[CO_2]}$$

By substitution one obtains $$\frac{d[Ca^{2+}]}{dt} = \frac{55.56}{K_D}\frac{P_{CO2}}{P}\left(\frac{k_1K_1}{[HCO_3^-]} + k_2\right)$$

As before, this equation implies that the attack on the rock matrix can be suppressed by decreasing the partial pressure of $CO_2$. An increase of the total pressure of the system is more difficult to engineer because the steam will condense with gas co-injection to keep the total pressure constant, but the co-injection of an NCG will reduce the partial pressure of the $CO_2$.

A further implication is that high bicarbonate (or, effectively, alkalinity) will also suppress the reaction. If the bicarbonate concentration of the connate water is not already high after dilution with steam condensate, the possibility of injecting 80% quality steam suggests itself. In that way the alkalinity usually found in the boiler blowdown will be available for suppression of the rock-corrosion by $CO_2$.

The usual problem associated with not separating the alkalinity via blowdown, namely the increase in silica production, should not be an issue in a carbonate rock matrix. However, there is a danger that stray barium in the pay zone will react with sulphate in the blowdown, to precipitate barium sulphate. Barium sulphate is extremely insoluble in water and cannot be removed by acids. This has to be tested for and eliminated before the 80% steam option is resorted to. A detailed chemical study of both boiler feed water and formation water is required before this option is used.

It is clear, therefore, that the co-injection of a NCG is capable of suppressing the formation damage effect that is to be expected from reactions that commonly occur in limestone caves and was also inferred from CSS results. The mole fraction of carbon dioxide in hot zones of thermal recovery projects is known to be of the order of 30 to 60 mole %. Therefore, even co-injection of a flue gas, containing some 11 mole %, may suffice in a dolomite zone to suppress the formation damage effects. Although the total $CO_2$ is increased, the partial pressure of $CO_2$ is reduced, leading to a reduced dissolution of the carbonates within the formation.

The same is less likely to be true in a limestone zone (compare for example FIG. 1, the solubility of limestone is ten times that of dolomite at any given concentration of $CO_2$), so even small mole fractions of carbon dioxide will provide enough carbon dioxide solubility to dissolve significant amounts of calcium. In this case, a NCG free of carbon dioxide is preferable.

The degree of co-injection as a function of steam rate, or of injection of gas where some other means is used to heat the bitumen-bearing reservoir, and the decision as to whether gas is injected or co-injected continuously or intermittently, and the choice of the gas, is left to one skilled in the art of thermal reservoir engineering and associated vapour-liquid equilibria for both oil and water on a case-by-case basis. Any gas may be suitable unless prohibited by other considerations such as corrosion or unwanted reactions with bitumen or heavy oil. Light hydrocarbon solvents that exhibit a significant vapour pressure at reservoir conditions will have the same effect as a gas (in reducing the partial pressure of $CO_2$).

Pressure

The invention may utilize any reservoir pressure that is appropriate to the operation in a particular case, and such pressure will be chosen by one skilled in the art of thermal reservoir engineering and vapour-liquid equilibria of gases with water and oil at elevated temperature and pressure.

Well Configuration & Operating Strategy

The invention is heavily dependent on chemical reactions in the carbonate reservoir, and well configuration and operating strategy are of importance only insofar as considerations of fluid flow in carbonate reservoirs, and production economics, dictate.

To recap, the dissolution of carbonate formation may be reduced by one of several methods, including:

Increasing the absolute pressure (which has the effect of lowering the $CO_2$ partial pressure);

Lower the $CO_2$ partial pressure, for example by utilizing gas injection (for example a gas excluding $CO_2$, or including $CO_2$ at sufficiently low levels to provide a net decrease in the overall $CO_2$ partial pressure); or Increasing the bicarbonate/alkalinity, for example by utilizing 80% quality steam (or some other quality wet steam) including the blowdown normally knocked out before injection.

Each of these methods may be applied alone, or in combination with one or more of the other methods.

Application of the Present Invention

The present invention applies to any heavy oil or bitumen deposit where the reservoir rock consists primarily of carbonate minerals. The pattern of the well arrangement may be altered as required in particular circumstances, and both horizontal or vertical wells in any suitable arrangement may be chosen by one skilled in the art of thermal recovery of bitumen or heavy oil. SAGD and CSS have been specifically mentioned herein, but other thermal recovery methods may also be used. In addition to steam, other sources of heat or energy or both may be utilized, for example electrical heating to provide a hot zone where the bitumen or heavy oil is mobilized.

Example Steps to Implementation

For the purpose of implementation of the invention, the method may include the following steps:

Obtain knowledge of the type of carbonate rock.

Determine the data similar to Table 1 for the planned temperature and pressure of the hot zone, for example by means of a suitable water quality modeling software (SOLMINEQ, by the Alberta Research Council, or equivalent).

Calculate the expected baseline carbon dioxide concentration without any suppression (e.g. no gas injection), for example by means of the method of Thimm (Journal of Canadian Petroleum Technology, Vol 40(11), pp 50-53 (November 2001), or from existing production data of comparable reservoirs, estimate the gas production and produced gas composition.

Select a desired reduction in the rock dissolution effect, to a level that is tolerable (either by prediction or from data acquired from experience or laboratory experimentation); and Select a gas and a gas injection rate (and/or other suppression method discussed herein) that will reduce the rock dissolution effect to the selected level.

During production, it will be important to frequently measure and analyze the produced water and produced gas, to monitor the production and adjust gas injection accordingly. The use of a model such as SOLMINEQ is recommended to help evaluate the field data.

In the preceding description, for purposes of explanation, numerous details are set forth in order to provide a thorough understanding of the embodiments of the invention. However, it will be apparent to one skilled in the art that these specific details are not required in order to practice the invention.

The above-described embodiments of the invention are intended to be examples only. Alterations, modifications and variations can be effected to the particular embodiments by those of skill in the art without departing from the scope of the invention, which is defined solely by the claims appended hereto.

What is claimed is:

1. A method for producing bitumen or heavy oil from a subterranean reservoir having a carbonate mineral solid matrix comprising:

operating a thermal recovery process within the reservoir in order to produce the bitumen or heavy oil; and utilizing one or more suppression methods selected from the group consisting of:

injecting a gas substantially free of carbon dioxide into the reservoir to decrease a partial pressure of $CO_2$ in the reservoir;

injecting a carbon dioxide containing gas, containing a relatively low amount of carbon dioxide, into the reservoir to decrease the partial pressure of $CO_2$ in the reservoir;

injecting wet steam into the reservoir, providing bicarbonate to increase the alkalinity in the reservoir; and increasing the reservoir pressure to decrease the partial pressure of $CO_2$ in the reservoir;

such that dissolution and re-precipitation of the carbonate mineral is selectively suppressed.

2. The method of claim 1, wherein the partial pressure of $CO_2$ in the reservoir is selectively controlled.

3. The method of claim 1, wherein the thermal recovery process is steam assisted gravity drainage (SAGD), cyclic steam stimulation (CSS), or electric heating.

4. The method of claim 1, wherein the gas comprises air.

5. The method of claim 1, wherein the gas is co-injected with steam.

6. The method of claim 1, wherein the steam has a steam quality of less than about 100 percent.

7. The method of claim 6, wherein the steam quality is less than about 80 percent.

8. The method of claim 1, wherein the carbon dioxide containing gas comprises flue gas.

9. The method of claim 8, wherein the flue gas comprises diluting air.

10. The method of claim 1, wherein bitumen or heavy oil, produced water, and produced gas are produced from the reservoir.

11. The method of claim 10, further comprising determining the amount and composition of produced gas and adjusting the gas injection to compensate.

12. The method of claim 10, further comprising determining the amount and composition of produced gas in solution in the produced water, bitumen, or heavy oil and adjusting the gas injection to compensate.

13. The method in claim 1 wherein light hydrocarbon solvents are injected with or instead of the gas.

14. The method of claim 13, wherein the light hydrocarbon solvents comprise propane, butane, or pentane, or mixtures thereof.

15. The method of claim 1, wherein two or more of the suppression methods are utilized in combination or in sequence.

16. The method of claim 1, wherein one or more of the suppression methods, or combinations thereof are used intermittently, periodically, or continuously.

17. The method of claim 1, wherein the one or more suppression methods are selected from the group consisting of:

injecting a gas substantially free of carbon dioxide into the reservoir to decrease the partial pressure of $CO_2$ in the reservoir;

injecting a carbon dioxide containing gas, containing a relatively low amount of carbon dioxide, into the reservoir to decrease the partial pressure of $CO_2$ in the reservoir; and increasing the reservoir pressure to decrease the partial pressure of $CO_2$ in the reservoir; and further comprising monitoring the $CO_2$ partial pressure in the reservoir and adjusting one or more of the suppression methods to selectively lower decrease the $CO_2$ partial pressure in the reservoir.

18. A method for producing bitumen or heavy oil from a subterranean reservoir having a carbonate mineral solid matrix comprising:

operating a thermal recovery process within the reservoir in order to produce the bitumen or heavy oil; and injecting a non-condensible gas into the reservoir to decrease a partial pressure of $CO_2$ in the reservoir, such that dissolution and re-precipitation of the carbonate mineral solid matrix is selectively suppressed.

19. The method of claim 18, wherein the gas comprises a gas substantially free of carbon dioxide.

20. The method of claim 18, wherein the gas comprises a carbon dioxide containing gas, containing a relatively low amount of carbon dioxide.

21. The method of claim 18, wherein the gas comprises air.

22. The method of claim 18, wherein the gas is co-injected with steam.

23. The method of claim 22, wherein the steam has a steam quality of less than about 80 percent.

24. The method of claim 18, wherein bitumen or heavy oil, produced water, and produced gas are produced from the reservoir.

25. The method of claim 24, further comprising determining the amount and composition of produced gas and adjusting the gas injection to compensate.

26. The method of claim 24, further comprising determining the amount and composition of produced gas in solution in the produced water, bitumen, or heavy oil and adjusting the gas injection to compensate.

27. The method in claim 18 wherein light hydrocarbon solvents are injected with or instead of the gas.

28. The method of claim 27, wherein the light hydrocarbon solvents comprise propane, butane, or pentane, or mixtures thereof.

* * * * *